United States Patent [19]

Enokizono

[11] 4,326,201

[45] Apr. 20, 1982

[54] APPARATUS FOR DISPLAYING CHARACTERS

[75] Inventor: Takatoshi Enokizono, Fussa, Japan

[73] Assignee: Tokyo Shibaura Denki Kabushiki Kaisha, Kawasaki, Japan

[21] Appl. No.: 143,799

[22] Filed: Apr. 25, 1980

[30] Foreign Application Priority Data

Apr. 27, 1979 [JP] Japan ..... 54-51440

[51] Int. Cl.[3] ..... G09G 1/16

[52] U.S. Cl. ..... 340/717; 340/750; 340/800

[58] Field of Search ..... 340/705, 709, 717, 744, 340/750, 800

[56] References Cited

U.S. PATENT DOCUMENTS 3,696,394 10/1972 Kashio ..... 340/750 X
3,777,059 12/1973 Wilkey ..... 340/717 X
3,792,198 2/1974 Hanson et al. ..... 178/7.91

FOREIGN PATENT DOCUMENTS 51-45211 12/1976 Japan .

*Primary Examiner*—David L. Trafton
*Attorney, Agent, or Firm*—Kenyon & Kenyon

[57] ABSTRACT

A display system with a single character generator is provided with a CRT controller. A raster address produced from the CRT controller and a raster address inverted by a raster address converting circuit are applied to a multiplexer. The multiplexer is further supplied with the most significant bit of a refresh memory address. Depending on the logical state of the most significant bit, the multiplexer selects the raster address or an inverted raster address outputted from the CRT controller 44 and supplies the selected address to the character generator. Display pattern information outputted from the character generator is applied to a bidirectional shift register. Depending on the logical state of the most significant bit of the refresh memory address, the display pattern information is shifted to the right or to the left. The output of the bidirectional shift register 43 is displayed on the CRT 22 and is supplied to station #1 or station #2 by a mirror reflection.

7 Claims, 13 Drawing Figures

APPARATUS FOR DISPLAYING CHARACTERS

BACKGROUND OF THE INVENTION

The present invention relates to a display system and, particularly, to a display system in which a screen of a display unit of the raster scan type is divided into a plurality of sections and display information is supplied to respective stations, sections or screens by using mirror reflections.

A key to FDD (floppy disc drive) using a floppy disc for a recording medium has gradually increased, superseding the conventional punch card system. The key to the FDD will be referred to as a data system. There has been an increased demand for a two-operator data system of the type which allows two operators to works individually, particularly in light of its cost/performance ratio. A two-operator data system will be called a multiple data system. Most multiple data systems are of the type in which two screens are provided by a single display unit, with mirrors for reflecting the data displayed on the display unit (CRT) toward the two operators. Thus, in this type data system, a single screen is divided in two and each divided screen section provides display information to a respective operator.

A multiple data system of this type, however, needs two different character generators, one for each of the respective stations, leading to an increase in manufacturing cost. Accordingly, those systems have the drawback that in order to increase the capacity of the system, the number of display characters must be increased. An additional problem is that, for checking the display, an operator must check the respective character patterns.

SUMMARY OF THE INVENTION

Accordingly, an object of the invention is to provide a display system with a single character generator for both sections or stations of a divided CRT screen.

To achieve the above object, there is provided an apparatus for displaying characters which divides a display screen of the raster scan type and supplies display information to the respective sides by using a mirror reflection, comprising: a programmable CRT controller; a refresh memory for storing coded data to be displayed in response to a refresh memory address obtained from the controller; raster address converting circuit means which receives the raster address from the controller and converts it to a converted raster address; multiplexer means for selecting the raster address from the controller and the converted raster address from the raster address converting circuit means on the basis of control information contained in the refresh memory address; a character generator for converting the coded data from the refresh memory into pattern data on the basis of raster address information from the multiplexer means; bidirectional shift register means which receives the pattern data from the character generator, determines a shift direction thereof on the basis of control information contained in the refresh memory address, and produces serial dot data; and a display unit for displaying the dot data from the bidirectional shift register.

BRIEF DESCRIPTION OF THE DRAWINGS

Other objects and features of the invention will be apparent from the following description taken in connection with the accompanying drawings, in which.

DESCRIPTION OF THE PREFERRED EMBODIMENTS

Figure 1:
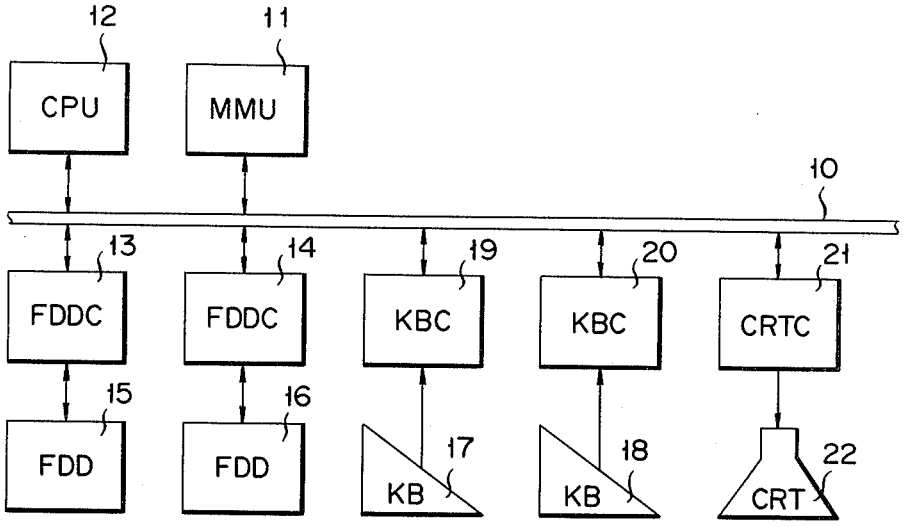
FIG. 1 is a block diagram of a multiple data system to which the present invention is applied.

FIG. 1 shows a multiple data system to which a display system according to the invention is applied. A main memory unit (MMU) 11 connected to a system bus 10 including an address line, a data line and a control line comprises a basis read only memory (ROM) and a random access memory (RAM) and stores programs and data through the system bus 10. A central processing unit (CPU) 12 is connected to the system bus 10 and performs arithmetic operations and controls the overall system in accordance with a program stored in the MMU 11. Floppy disc drive controllers (FDDC) 13 and 14 are connected to the system bus 10 and through it to floppy disc drive units (FDD) 15 and 16. The FDDs 15 and 16 store programs and data overflowed from the MMU 11. The keyboards (KB) 17 and 18 are connected through keyboard controllers (KBC) 19 and 20 to the system bus 10. The data keyed in by the KBs 17 and 18 is temporarily stored in the MMU 11 through the system bus 10 and then is stored in the FDDs 15 and 16. At the same time data is applied through a CRT controller 21 (CRTC) connected to the system bus 10 to a CRT 22 connected to the CTRC 21. The CRTC 21 holds the display data of the CRT 22, makes a data conversion, and produces synchronizing signals for the CRT 22. The CRT 22 is so designed as to provide two picture screens corresponding to the stations. The FDD 15 and KB 17 are assigned to station 1, and the FDD 16 and the KB 18 are assigned to station 2.

Figure 2:
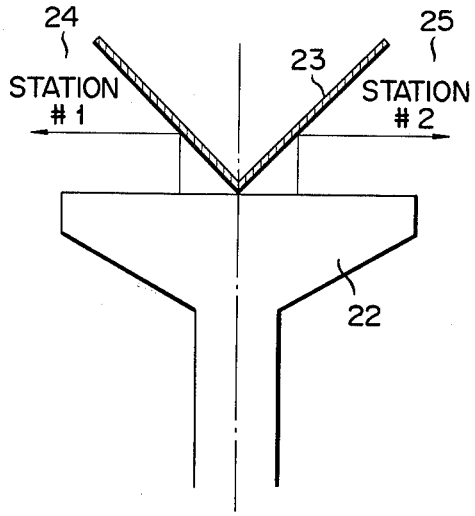
FIG. 2 is a diagram illustrating a single display unit having two screens, sections or stations.
Figure 3:
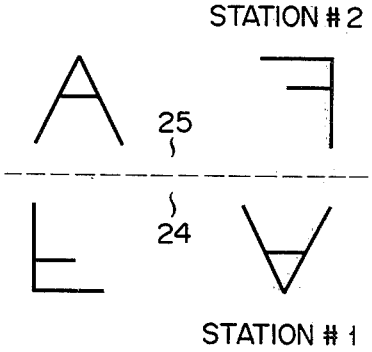
FIG. 3 is a display of the characters "F" and "A" on both stations of the picture screen of FIG. 2.

FIG. 2 illustrates the principle of providing two stations from a single picture screen. As shown, images displayed on the CRT 22 are reflected by a mirror 23 toward the respective stations #1 24 and #2 25 for the respective operators. That is, one screen is divided into two sections. The divided sections of the screen provide the information to the operators at the respective stations. When each station is provided with the characters "F" and "A", the format of the characters displayed on the screen are shown in FIG. 3. In FIG. 2, the section above the central broken line is station #2 25 and the section below the broken line is station #1 24.

Figure 4:
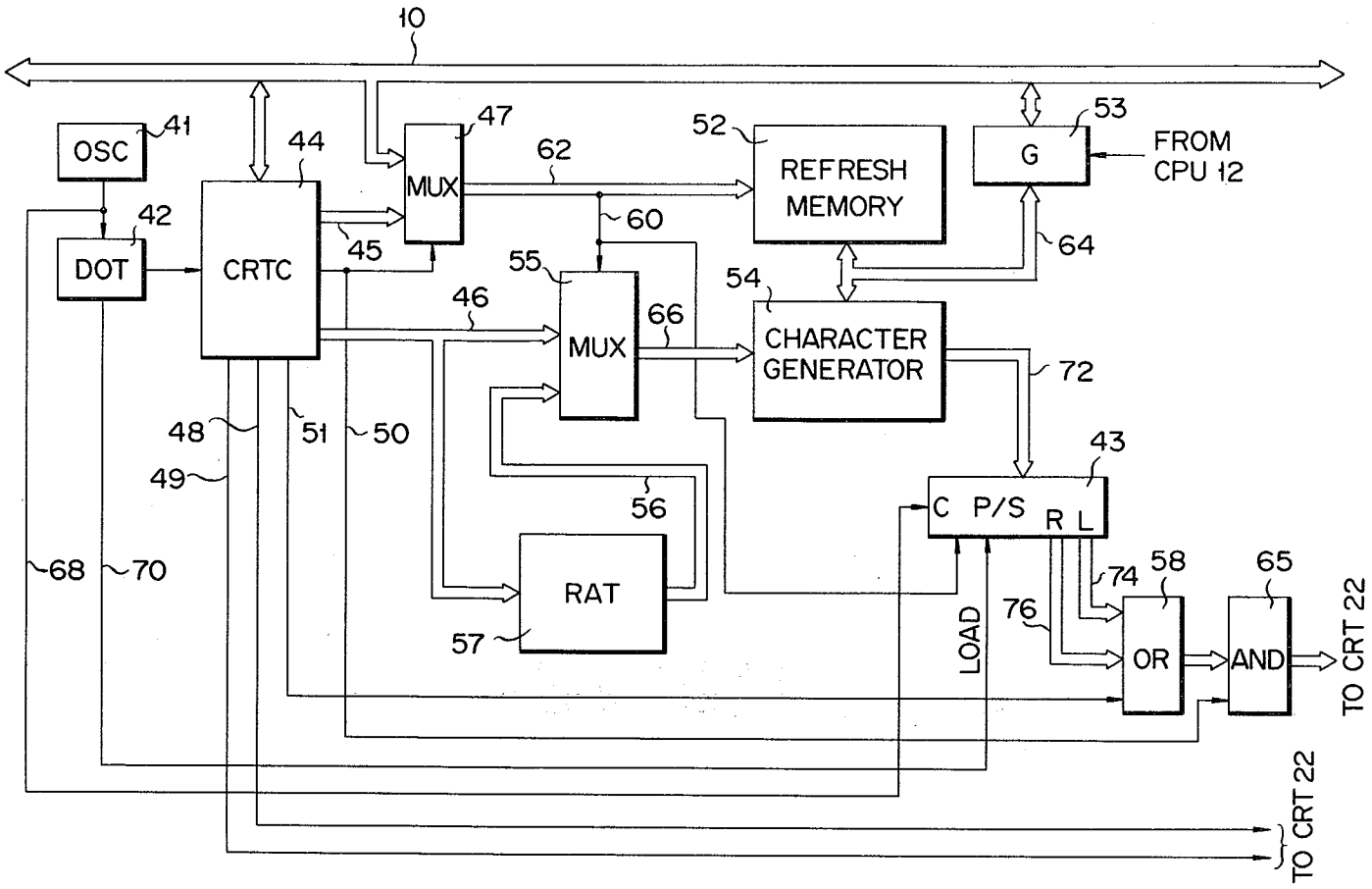
FIG. 4 is a block diagram of an embodiment of a raster scan type display system with a single character generator.

FIG. 4 is a block diagram of a embodiment of a display system having a single character generator according to the invention. In FIG. 4, an oscillator 41 produces clock signals providing dots to form a character on the screen of the CRT 22. A dot counter (DOT) 42 connected to the oscillator 41 counts the clock signals from the oscillator 41 to produce the count data for each character display. The count data outputted from counter 42 is applied to a CRT controller 44 and a bidirectional shift register 43. The CRT controller 44 is connected to the system bus 10 and the dot counter 42. The CRT controller 44 is used as an interface between CPU 12 and CRT 22 of the raster scan type. HD46505 (programmable CRT controller) of LSI(large scale integration), for example, may be used for the controller 44. The CRT controller 44 performs the following controls: the period of horizontal scanning, the period of vertical scanning for each line, the number of characters displayed on each line, the number of rasters for each line, the number of lines on one screen, a display position in a vertical direction on the CRT 22, the pulse width of a horizontal synchronizing signal, the position of a cursor on the CRT 22, and the designation of an address for making an access to the refresh memory. Accordingly, the display may be programmably formed on the CRT screen using the above controls as parameters.

Specifically, the CRT controller 44 produces a horizontal synchronizing signal on line 48 and a vertical synchronizing signal on line 49 which are applied to the CRT 22. The controller 44 further supplies a display timing signal on line 50 to a multiplexer 47 and an AND circuit 65. It supplies a cursor display signal on line 51 to OR circuit 58. Controller 44 further applies refresh address signals for a refresh memory 52 on bus line 45 to the multiplexer 47 and applies raster address signals on bus line 46 to a multiplexer 55 and a raster address converting circuit (RAT) 57. The multiplexer 47 receives a write address from the system bus 10 for writing coded data into the refresh memory and a refresh memory address for reading coded data from the refresh memory from the CRT 44 and selects one of those addresses to be outputted on bus line 62.

A refresh memory e.g. a (RAM) 52 is connected by bus line 62 to the multiplexer 47 and through a gate 53 to the system bus 10. The refresh memory (RAM) 52 is capable of storing the display information of one picture screen, for example, 1024 characters. The refresh memory 52 is accessed by the address information coming through the multiplexer 47 and the coded data read out therefrom is supplied to a character generator 54. Gate 53 is used as a control gate to provide the display data coming through the system bus 10 to the refresh memory 52. Gate 53 is connected to the system bus 10 and by bus line 64 to the refresh memory 52 and the character generator 54. The character generator is constructed by a read only memory (ROM) and is connected to the refresh memory 52 and the multiplexer 55, by bus line 66.

The character generator 54 converts the coded data outputted from the refresh memory 52 to pattern information in accordance with information which is a composite of the display data from the refresh memory 52 and the rastor address from the CRTC 44 through the multiplexer 55. The multiplexer 55 connected to the CRTC 44 is supplied with the raster address on line 46 and with the raster address conversion information on line 56 from the raster address converting circuit 57. The most significant bit of the address information outputted from the multiplexer 47 is applied on line 60 to the multiplexer 55 and to the bidirectional shift register 43. When the most significant bit of the address is a logical "0", the muliplexer 55 selects a raster address from line 46. When the most significant bit is a logical "1", the multiplexer 55 selects the converted raster address from the raster address conversion circuit. The bidirectional shift register 43 is shifted to the right when the most significant bit is a logical "0" and is shifted to the left when the most significant bit is logical "1".

The raster address converting circuit 57, comprised of an inverter, is connected to the CRT 44 by bus line 46. The raster address converting circuit 57 inverts the raster address information supplied from the CRTC 44. The inverted address information is supplied to the multiplexer 55.

The bidirectional shift register 43 is connected by line 68 to the oscillator circuit 41, by line 70 to the dot counter 42, and by bus line 72 to the character generator 54.

The shift register 43 receives an output signal from the dot counter 42 to fetch the character pattern information outputted from the character generator 54. Then, it shifts the contents fetched from the character generator to the right or to the left as clocked by the output signal from the oscillating circuit 41. The direction of the shift depends on the control signal (the most significant bit (MSB) of the address information from the refresh memory 52) outputted from the multiplexer 47. When the MSB is, for example, a logical "0", the shift register shifts the contents to the right, for example. Correspondingly, when the MSB is a logical "1", the register shifts the contents to the left. The above relation between the MSB and the shifting direction may be reversed, if desired.

Shift register 43 is connected to an OR circuit by bus lines 74 and 76. The OR circuit is further supplied with a cursor display signal from the CRTC 44 on line 51. The output signal from the OR circuit 58 is supplied to the AND circuit 65. The AND circuit 65 is supplied with a display timing signal from the CRTC 44 on line 50. The display timing signal gates the output signal from the shift register 43 or the cursor display signal from the CRTC 44 through the AND circuit 65 to the CRT 22.

Figure 5:
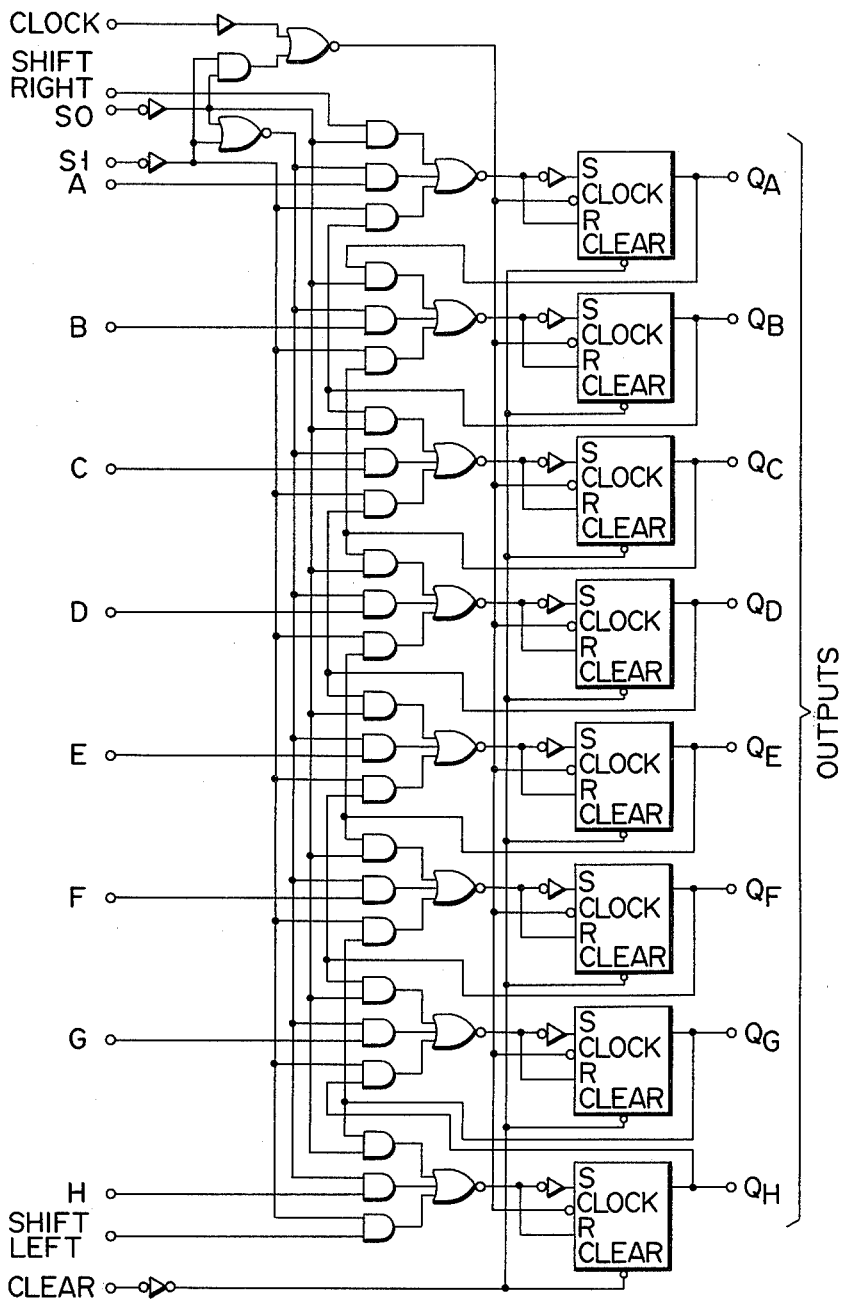
FIG. 5, including A-H, is a detailed logic schematic diagram of a bidirectional shift register used in the circuit shown in FIG. 4.

FIG. 5 is a logic circuit diagram of the bidirectional shift register 43 shown in FIG. 4. Shift register 43 may be an Ser. No. 74198 8-bit parallel access right-shift register manufactured by Texas Instruments Co. or the equivalent. The shift register with all the desired functions has parallel inputs, parallel outputs, a right shift input, a left shift input, operation mode control inputs and a direct clear input. The operation mode control inputs (S1 and S0) enable the following modes to be selected:

(1) Parallel load
(2) Shift right
(3) Shift left
(4) Clock inhibition (No operation is performed)

In the case of a parallel load, 8 bit data is applied to inputs A to H and is stored in the respective flip-flops. In the case of a shift right, the right shifting of the data is performed in synchronism with the leading edge of the input clock pulse. At this time, the serial data is applied to the shift right terminal. In a shift left, if the serial data is applied to the shift terminal, the data is similarly shifted to the left in response to the input clock pulse. In order to inhibit clocking of the flip-flop, logical "0"'s are applied to mode control inputs S0 and S1. The following table indicates the functions performed for the logical signals applied to mode control inputs S1 and S0.

TABLE 1

| Input | | |
|---|---|---|
| S1 | S0 | Operation Mode |
| 0 | 0 | Clock Inhibit |
| 0 | 1 | Shift Right |
| 1 | 0 | Shift Left |
| 1 | 1 | Parallel Load |

For the details of the Sn 74198 shift register such as operation timing, reference shall be made to "TTL Application Manual Data Book" published by Texas Instruments Co.

Figure 6:
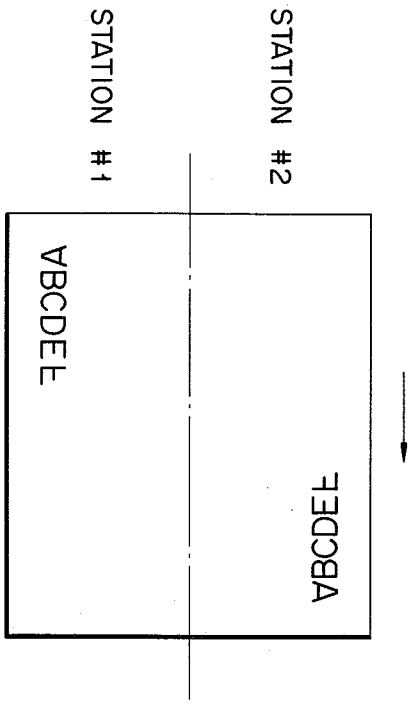
FIG. 6 shows formats of characters on the stations obtained when the invention is applied to the data system of FIG. 1.

The operation of the display system according to the invention will be described in detail referring to FIGS. 4-6.

In the explanation to follow, the following definition apply. The refresh memory address is a signal to divide the CRT screen in two. The raster address outputted from the CRTC 44 has a number of rasters for one line. The signal outputted from the CRTC 44 is a display permission signal (during the non-display period, the signal is a disable signal and the display is inhibited). The format of display on the display screen is as shown in FIGS. 3 and 6.

When data is displayed at station 1, the raster address on line 46 is selected by the multiplexer 55. Upon data being displayed at station 2, the output from the raster address conversion circuit 57 is selected by the multiplexer 55.

The CRT controller 44 produces the refresh memory address on line 45. The refresh memory address is supplied to the refresh memory 52 through the multiplexer 47. The refresh memory 52, when receiving the refresh memory address, produces coded data from the memory location designated by the address. The coded data is supplied to the character generator 54. The character generator is further supplied with the raster address, through the bus line 46, the multiplexer 55 and the bus line 66. As a result, the character generator 54 is accessed by the composite information of the raster address and the coded data. When receiving the composite data, the character generator 54 produces pattern data from the memory location designated by the composite information and applies it to the bidirectional shift register 43, on bus line 72. The bidirectional shift register 43 responds to a LOAD signal outputted from the dot counter 42 to fetch the pattern data outputted from the character generator. The bidirectional shift register 43 has been supplied with a signal of logical "0", so that the display data is supplied to the station #1 24. Accordingly, the register 43 responds to the clock signal outputted from the oscillator 41 and shifts the display information to the right to produce it in serial fashion. The display data outputted is supplied to the OR circuit 58. The OR circuit is supplied with a cursor display signal on line 51. The output of the OR circuit 58 is supplied to the AND circuit 65. In response to the display timing signal outputted on line 50 from the CRTC 44, the AND circuit 65 produces an output signal to the CRT 22. To the CRT 22 are further applied the horizontal and the vertical synchronizing signals on lines 48 and 49, respectively. Display data is displayed on the CRT 22 in response to the output of the AND circuit 65 and the horizontal and vertical synchronizing signals. Through repitition of the above-described operation, display information is displayed.

When display information is to be displayed on the station #2 25, the most significant bit of the refresh memory address information outputted from the multiplexer 47 is a logical "1". As a result, the multiplexer 55 outputs the inverted raster address from the raster address conversion circuit 57 and not the raster address from the CRTC 44. The composite of the inverted raster address and coded data outputted from the refresh memory 52 produce display information from the corresponding memory location. A logical "1" signal is applied to the bidirectional shift register 43 on line 60. As a result, the shift register 43 shifts the display information outputted from the character generator 54 to the left. The shifted information is supplied through the OR circuit 58 and the AND circuit 65 to the CRT 22 where the display information is displayed on the station #2 25.

As described above, the display system of the invention is provided with a raster address converting circuit and a bidirectional shift register, so that it easily provides a two-screen inverted display. Further, a common character generator is used for both stations #1 and #2. The use of a single character generator reduces manufacturing cost and the number of parts that have to be assembled into the printed circuit board. The reduction in the number of the parts simplifies circuit construction and improves reliability.

What is claimed is:

1. An apparatus for displaying characters which divides a display screen of the raster scan type and provides display information to the respective divided sides by using a mirror reflection, comprising:

a programmable CRT controller;

a display unit for displaying dot data in a raster scan manner;

a refresh memory for storing coded data to be displayed in response to a refresh memory address obtained from the programmable CRT controller;

raster address converting circuit means which receives a raster address from the controller and converts the raster address to a converted raster address;

multiplexer means for selectively outputting the raster address from the controller and the converted raster address from the refresh memory address converting circuit means on the basis of control information contained in the refresh memory address;

a character generator for converting the coded data from the refresh memory into pattern data on the basis of raster address information from the multiplexer means; and bidirectional shift register means which receives the pattern data from the character generator, determines a shift direction thereof on the basis of control information contained in the refresh memory address and produces serial dot data which is coupled to the display unit.

2. An apparatus for displaying characters according to claim 1, in which the multiplexer means selects the raster address so that the pattern information is supplied to one side of the display screen for display when the control information has one value, and selects the converted raster address so that the pattern information is supplied to the other side of the display screen for display when the control information has another value.

3. An apparatus for displaying characters according to claim 1, wherein the bidirectional shift register shifts the pattern information in one direction to output it in serial fashion so that the pattern information is supplied to one side of the display screen for display when the control information has one value, and shifts the pattern information in the other direction to output it in serial fashion so that the pattern information is supplied to the other side of the display screen for display when the control information has another value.

4. An apparatus for displaying characters including:

a programmable CRT controller;

a display unit for displaying dot data in a raster scan manner;

an oscillating circuit for producing a basic clock signal;

a refresh memory for storing coded data to be displayed in response to a refresh memory address from the controller;

first multiplexer means which receives the refresh memory address obtained from the programmable controller for reading the refresh memory, and a write address from a central processing unit through an internal bus for writing coded data into the refresh memory, and selectively outputs address information on the basis of a control signal supplied from the programmable controller;

raster address converting circuit means which receives the raster address obtained from the controller and converts the raster address to a converted raster address;

second multiplexer means for selectively outputting the raster address from the controller and the converted raster address from the raster address converting circuit means on the basis of the control information contained in the refresh memory address;

a character generator for converting the coded data derived from the refresh memory into pattern data on the basis of raster address information obtained from the second multiplexer means; and bidirectional shift register means which receives the pattern information from the character generator to determine the shift direction on the basis of the control information contained in the refresh memory address and produces serial dot data which is coupled to the display unit.

5. An apparatus for displaying characters according to claim 4, wherein the control information supplied from the first multiplexer means to the second multiplexer means and to the bidirectional shift register means uses any one bit of the refresh memory address outputted from the first multiplexer means.

6. An apparatus for displaying characters according to claim 4, wherein the second multiplexer means selectively outputs the raster address so that the pattern information is supplied to one side of the display screen for display when the control information has one value, and selectively outputs the converted raster address so that the pattern information is supplied to the other side of the display screen for display when the control information has another value.

7. An apparatus for displaying characters according to claim 4, wherein the bidirectional shift register means shifts the pattern information in one direction to output it in serial fashion so that the pattern information is supplied to one side of the display screen for display when the control information has one value, and shifts the pattern information in the other direction to output it in serial fashion so that pattern information is supplied to the other side of the display screen for display when the control information has another value.

* * * * *

UNITED STATES PATENT AND TRADEMARK OFFICE

CERTIFICATE OF CORRECTION

PATENT NO. : 4,326,201

DATED : April 20, 1982

INVENTOR(S) : Enokizono

It is certified that error appears in the above—identified patent and that said Letters Patent is hereby corrected as shown below:

Col. 1, line 16, change "works" to --work--.

Col. 2, line 10, delete "including A-H".

Col. 3, line 55, change "rastor" to --raster--.

Col. 5, line 18, change "definition" to --definitions--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*